US006964304B2

(12) United States Patent
Skeels et al.

(10) Patent No.: US 6,964,304 B2
(45) Date of Patent: Nov. 15, 2005

(54) TECHNIQUE FOR MAINTAINING PRESSURE INTEGRITY IN A SUBMERSIBLE SYSTEM

(75) Inventors: Harold Brian Skeels, Kingwood, TX (US); Michael R. Williams, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 228 days.

(21) Appl. No.: 10/324,329

(22) Filed: Dec. 20, 2002

(65) Prior Publication Data

US 2004/0118567 A1 Jun. 24, 2004

(51) Int. Cl.[7] ..... E21B 29/12

(52) U.S. Cl. ..... 166/365; 166/95.1; 166/363; 137/81.2; 251/63.6; 251/329

(58) Field of Search ..... 166/365, 363, 166/95.1, 95.7, 85.1, 277; 137/14, 15.19, 81.2; 251/14, 62, 63, 63.4, 63.6, 329, 360

(56) References Cited

U.S. PATENT DOCUMENTS 4,572,298 A * 2/1986 Weston ..... 166/379
5,094,270 A * 3/1992 Reimert ..... 137/614.11
5,415,378 A * 5/1995 Craven ..... 251/329
5,772,216 A * 6/1998 Bredemeyer ..... 277/318
5,992,527 A 11/1999 Garnham et al. ..... 166/379
6,125,874 A * 10/2000 Holliday ..... 137/81.2
6,357,529 B1 * 3/2002 Kent et al. ..... 166/368
6,536,740 B2 * 3/2003 Hademenos et al. ..... 251/63.4
6,609,533 B2 * 8/2003 Sundararajan ..... 137/15.19
2003/0029619 A1 * 2/2003 Sundararajan ..... 166/361

FOREIGN PATENT DOCUMENTS

GB 2 103 688 8/1982 ..... E21B/34/02
GB 2 356 239 11/1999 ..... F16K/27/06
GB 2369176 * 5/2002

* cited by examiner

*Primary Examiner*—Jong-Suk (James) Lee
(74) *Attorney, Agent, or Firm*—Williams, Morgan & Amerson, P.C.

(57) ABSTRACT

A technique for maintaining pressure integrity within a submersible system. The system utilizes a pressure housing with an internal component, such as a valve. The internal component is actuated by an external actuator via an actuator stem. A seal region is positioned to interact with the stem, such that the interior of the pressure housing is sealed and pressure integrity is maintained upon retraction of the stem from engagement with the internal component.

25 Claims, 8 Drawing Sheets

TECHNIQUE FOR MAINTAINING PRESSURE INTEGRITY IN A SUBMERSIBLE SYSTEM

BACKGROUND OF THE INVENTION

Submersible systems are utilized in a variety of applications, such as subsea applications. For example, pressure and flow controlling devices, such as subsea test trees, facilitate the production of hydrocarbon-based fluids. Other pressure and/or flow control equipment, e.g. horizontal Christmas trees, also are used in subsea applications for the production of desired fluids.

In many subsea applications, there is an increasing demand for smaller trees and wellheads with larger bores and valves to control the flow of wellbore fluids. However, the drift diameters of pressure controlling equipment, such as subsea test trees or horizontal Christmas trees, are limited to certain sizes and/or pressure ratings. This is necessary to accommodate conventional valve closure devices and their corresponding actuator mechanisms which are permanently packaged together.

Additionally, removal of the valve or actuator during servicing or replacement requires disassembly of components of the pressure housing. Generally, such disassembly results in the breaking of "pressure tested" barriers and the loss of pressure integrity within the system. Loss of pressure integrity can result in the outflow of production fluid into the surrounding environment.

With horizontal Christmas trees, for example, if the valve or its actuator fail, it may become necessary to decomplete and seal off the well to maintain pressure integrity while the entire horizontal Christmas tree is recovered for repair. Such an operation is extremely expensive due to both the cost of recovering the Christmas tree as well as the production downtime when the well is sealed.

SUMMARY OF THE INVENTION

In one embodiment of the present invention, a submersible system, such as a subsea system, is designed for the control of pressure and fluid flow in the production of such fluid. The technique utilizes an internal device, such as a valve, controlled by an external actuator. The actuator interacts with the internal device, e.g. valve, via an actuator stem. Within the system, a seal region is disposed for selective engagement with the stem to ensure maintenance of internal pressure integrity. For example, if the internal device comprises a flow control valve, the valve may be removed for servicing while the stem seals against the seal region to maintain internal pressure integrity.

BRIEF DESCRIPTION OF THE DRAWINGS

Certain exemplary embodiments of the invention will hereafter be described with reference to the accompanying drawings, wherein like reference numerals denote like elements, and.

DETAILED DESCRIPTION OF EXEMPLARY EMBODIMENTS

Figure 1:
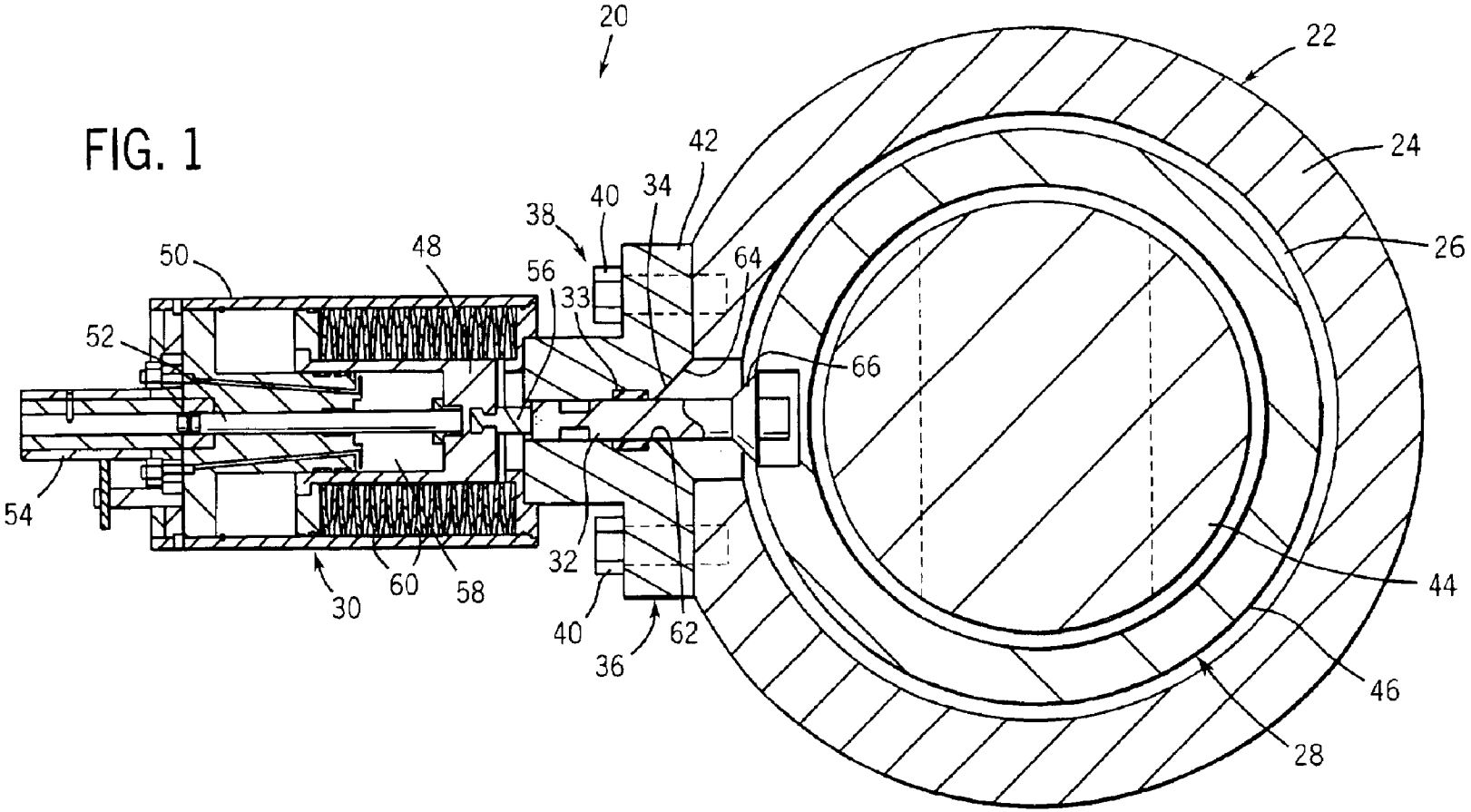
FIG. 1 is a cross-sectional view of a submersible device, according to one embodiment of the present invention.

Referring generally to FIG. 1, a submersible system 20 is illustrated according to one embodiment of the present invention. Submersible system 20 comprises a flow control structure 22 having a pressure housing 24 that defines a hollow interior 26. In many applications, hollow interior 26 forms an internal fluid flow path for a production fluid, such as a hydrocarbon-based fluid. As will be discussed more fully below, flow control structure 22 may be a subsea structure, such as a subsea tree, designed for use in controlling the pressure and flow of fluids from a wellbore drilled beneath the surface of a sea.

Submersible system 20 further comprises an internal component 28, an external actuator 30, a stem 32 and a seal region 34. In the exemplary embodiment illustrated, external actuator 30 is mounted to pressure housing 24 by a bonnet 36. Bonnet 36 may be mounted to the exterior of pressure housing 24 by an appropriate fastening mechanism 38, e.g., bolts 40. In this example, bolts 40 extend through a bonnet flange 42 and are threadably received in pressure housing 24.

Internal component 28 may comprise a variety of actuatable components. However, in the embodiment illustrated, internal component 28 comprises a valve assembly having a valve 44 and a valve closure mechanism 46. Actuator stem 32 cooperates with valve closure mechanism 46 to selectively open and close valve 44. In a variety of subsea applications, valve 44 comprises a gate valve. However, depending on the application, valve 44 also may comprise a ball valve or other type of actuatable valve.

Figure 2:
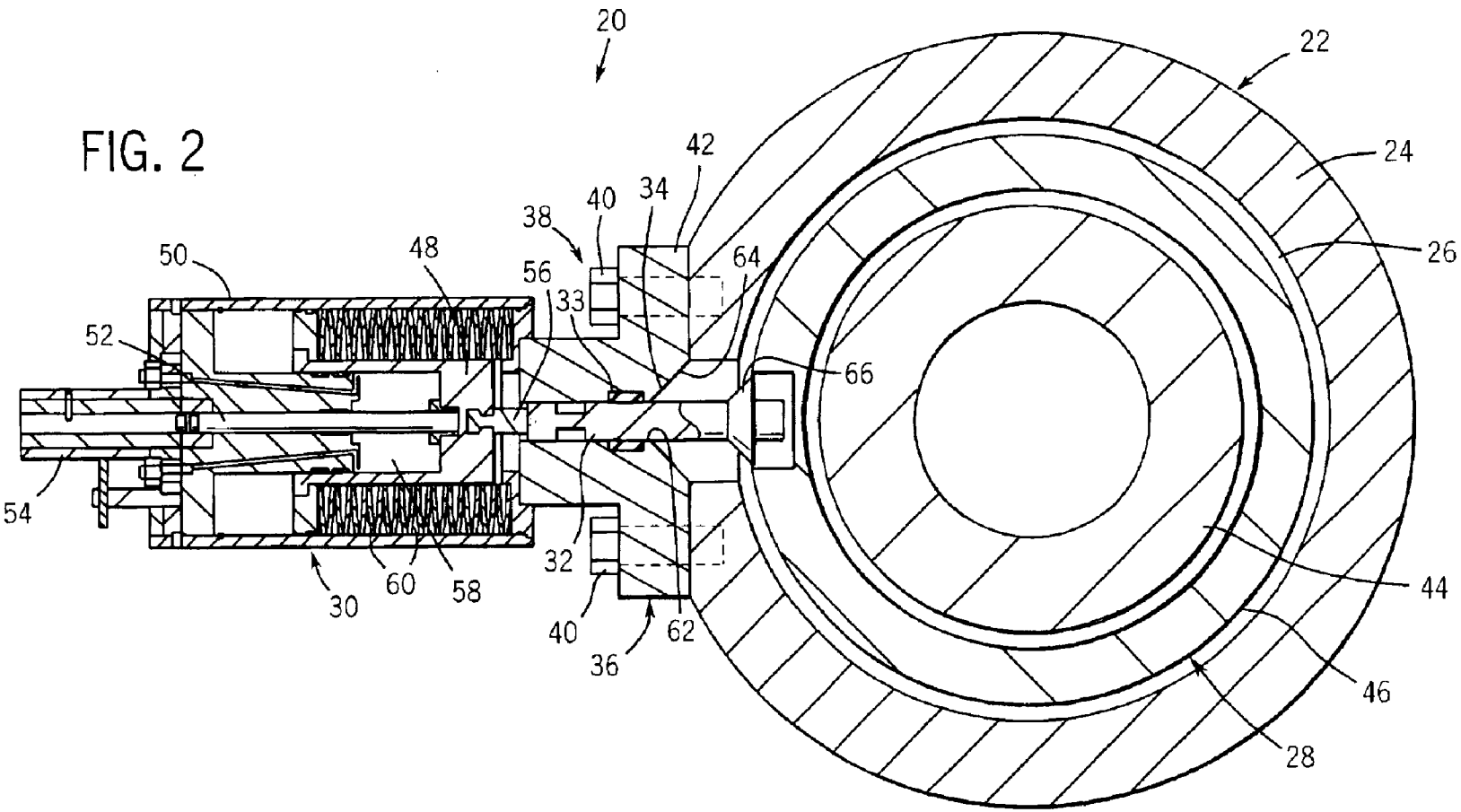
FIG. 2 is a view similar to FIG. 1 showing an internal device actuated to a desired position.

As illustrated best in FIG. 2, stem 32 can be utilized in actuating valve 44 from a closed position (see FIG. 1) to an open position, as best illustrated in FIG. 2. Similarly, the actuator stem 32 can be used to actuate valve 44 from an open position (see FIG. 2) to a closed position, as best illustrated in FIG. 1. The actual movement of stem 32 will depend on the type of valve or other internal component with which it interacts, but one exemplary motion is linear motion in line with the axis of stem 32 to open and close a valve, e.g. valve 44.

Control over valve 44 is provided by external actuator 30, which is mounted externally to hollow interior 26 to, for example, maximize flow area along the internal fluid flow path defined by hollow interior 26. A variety of actuator types are available depending on the specific application, e.g., fail-close actuator or fail-open actuator; function of internal component 28, e.g. gate valve, ball valve, etc.; and mode of actuation, e.g. hydraulic, electrical, etc. In the embodiment illustrated, external actuator 30 is a hydraulically powered actuator having an internal piston 48 slidably mounted within an actuator housing 50.

Figure 3:
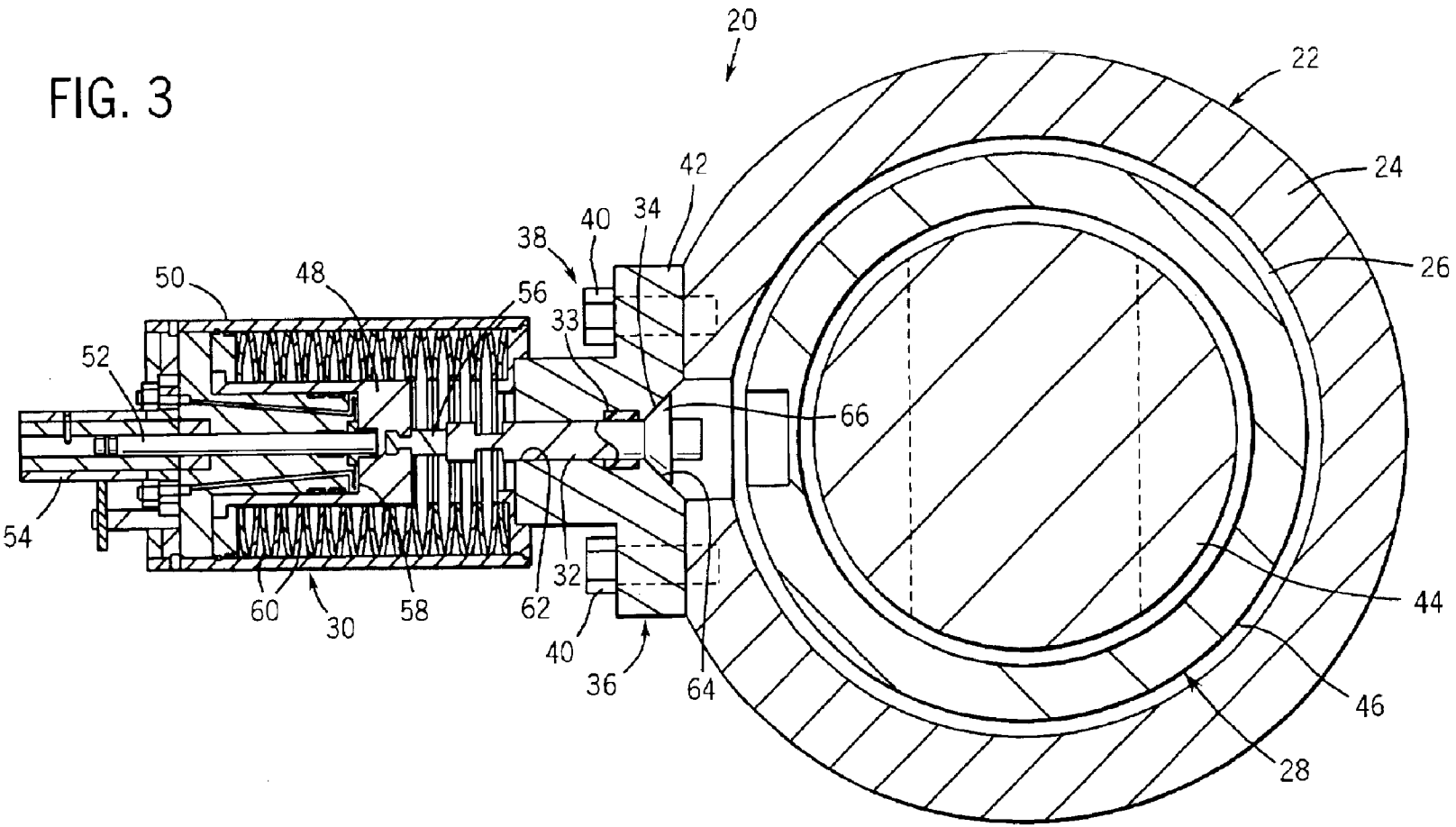
FIG. 3 is a view similar to FIG. 1 illustrating a retracted actuator stem, according to one embodiment of the present invention.

Piston 48 is coupled to stem 32 via an appropriate linkage 56. By introducing hydraulic fluid into a fluid chamber 58 under pressure, piston 48 is moved towards pressure housing 24 which, in turn, moves stem 32 in a linear direction to actuate valve 44 between the closed and open positions. When the pressure of the hydraulic fluid is decreased, a spring member 59 forces piston 48 and stem 32 in an opposite direction. If the hydraulic pressure is sufficiently decreased, stem 32 is fully retracted from engagement with internal component 28, e.g. valve 44, to a sealed position, as illustrated in FIG. 3. Actuator 30 may also comprise a hydraulic override rod 60 engaged with piston 48 and slidably mounted in a sleeve 61. Sleeve 61 allows access to override rod 60 by, for example, a remotely operated vehicle in the event of hydraulic failure.

In the embodiment illustrated, stem 32 may be fully removed from internal fluid flow path 26 to permit removal of the internal component 28. It should be noted that stem 32 may be moved from an engaged position, as illustrated in FIGS. 1 and 2, to a fully retracted, sealed position, as illustrated in FIG. 3, by a variety of mechanisms. For example, the external actuator, the internal pressure within pressure housing 24 or a combination of external actuator and internal pressure can be used to force stem 32 to the fully retracted position against seal region 34 (see FIG. 3).

When fully retracted, stem 32 is in engagement with seal region 34 to prevent the outflow of fluid from internal fluid flow path 26 to the environment surrounding flow control structure 22. As illustrated, stem 32 is slidably mounted within a passage 62 extending through bonnet 36. In this embodiment, seal region 34 is formed by a backseat 64. Stem 32 comprises a shoulder 66 positioned and shaped for mating engagement with backseat 64 when stem 32 is moved to the fully retracted position.

When shoulder 66 engages backseat 64, a seal is formed sufficient to maintain internal pressure integrity within pressure housing 24. In other words, fluid within the hollow interior 26 that forms the internal fluid flow path cannot escape proximate bonnet 36 and external actuator 30. Additionally, the cooperation of backseat 64 and shoulder 66 prevents stem 32 from being forced through bonnet 36.

Figure 4:
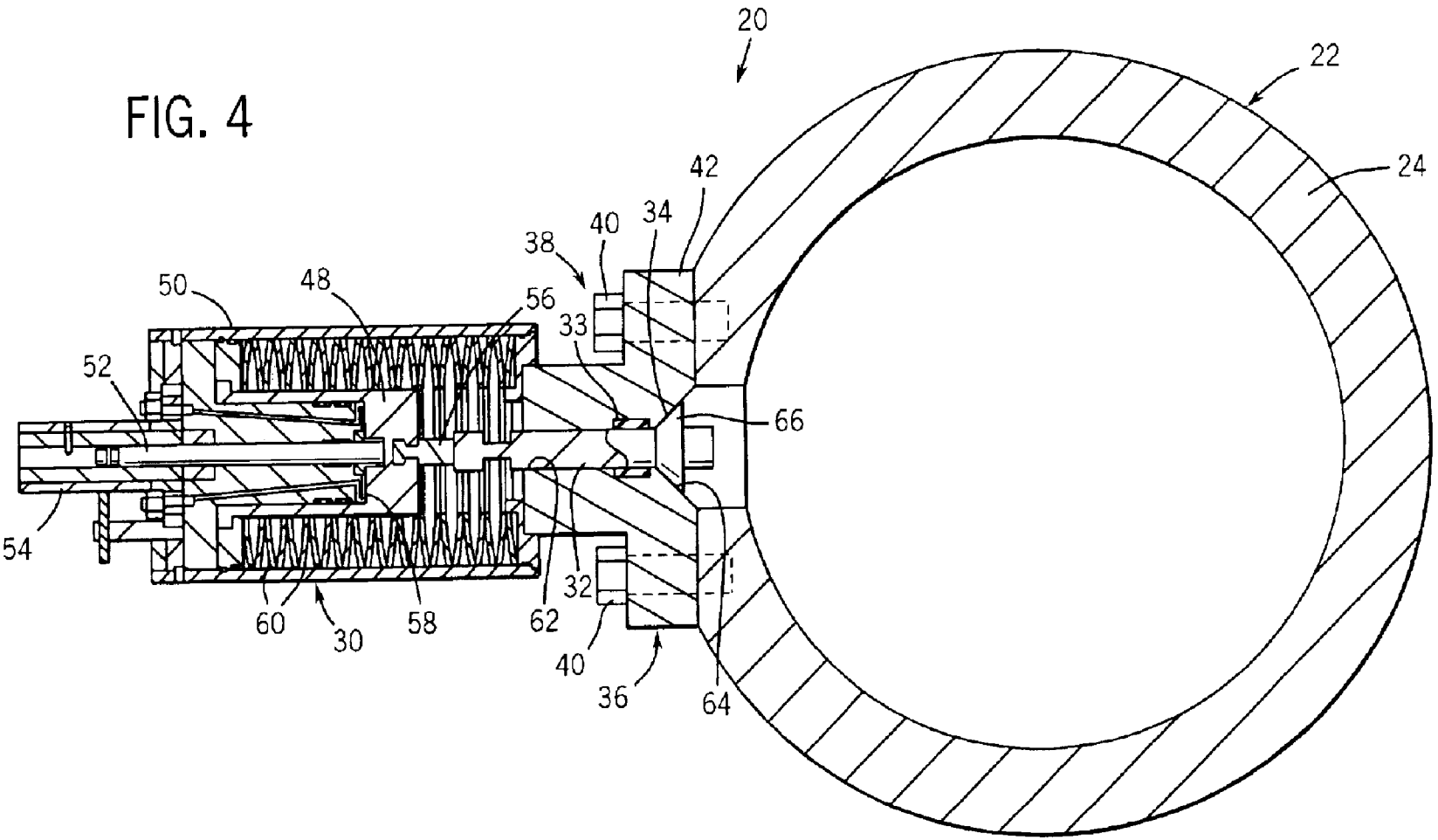
FIG. 4 is a cross-sectional view similar to FIG. 2 with the internal device removed.
Figure 5:
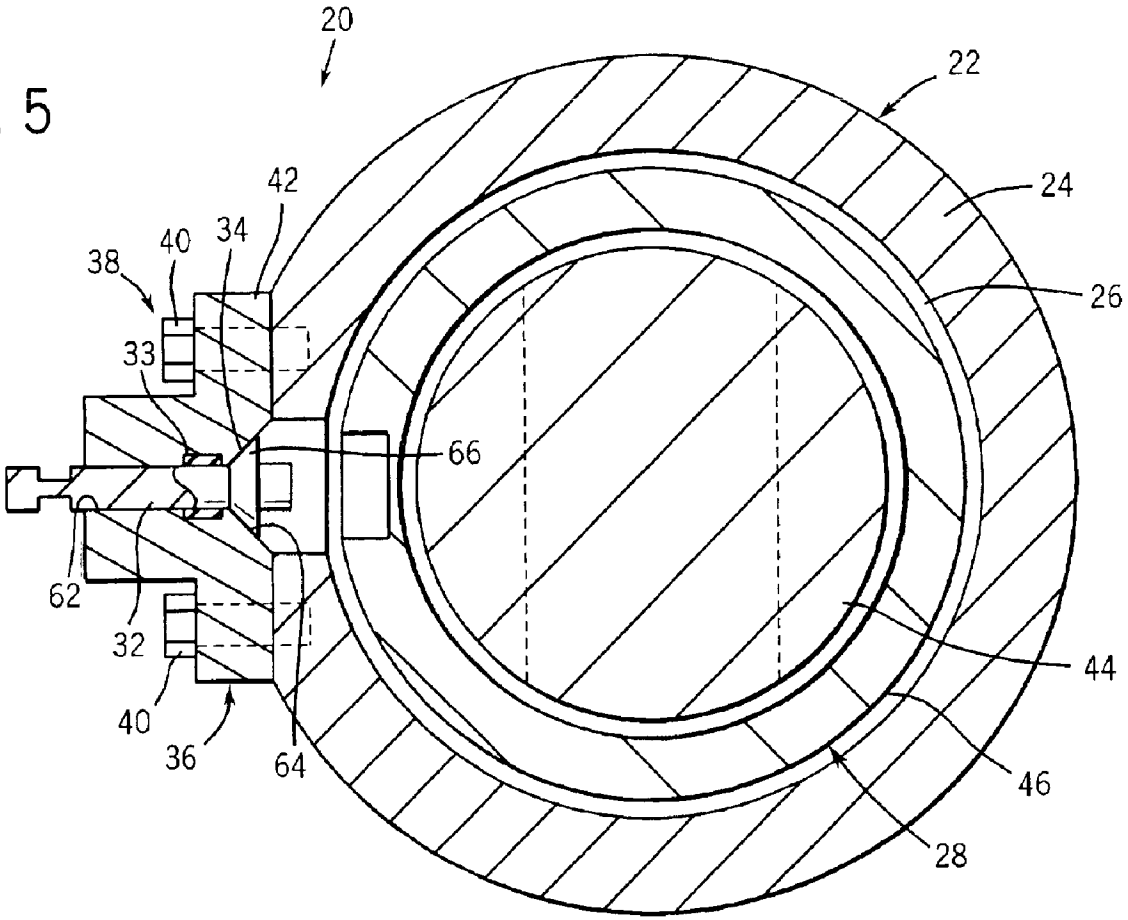
FIG. 5 is a cross-sectional view similar to FIG. 1 illustrating an embodiment with an external actuator removed.
Figure 6:
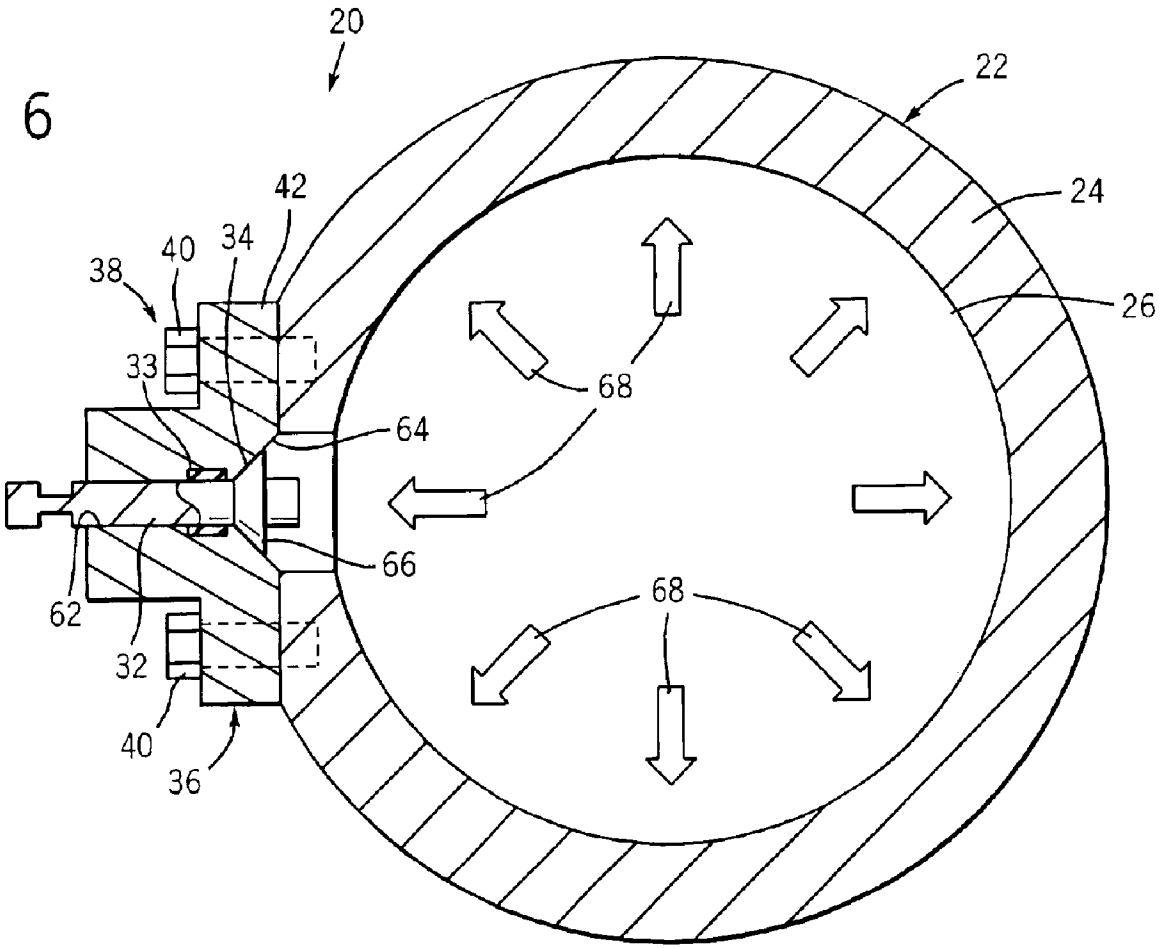
FIG. 6 is a view similar FIG. 1 with both an exemplary internal device and an exemplary actuator removed.

Thus, if valve 44 or other internal components 28 are removed, as illustrated in FIG. 4, the pressure integrity of interior 26 is not compromised. Similarly, if external actuator 30 is removed, as illustrated in FIG. 5, the pressure integrity within flow control structure 22 is maintained. In fact, even if both internal component 28 and external actuator 30 are removed, as illustrated in FIG. 6, the pressure integrity within flow control structure 22 is not compromised. Removal of external actuators and internal components can be accomplished by various methods used in subsea operations, including the use of remotely operated vehicles and the withdrawal of tubing strings to retrieve and/or repair components.

When the components are removed, the relatively greater internal pressure within pressure housing 24, as indicated by arrows 68 in FIG. 6, ensures that shoulder 66 remains firmly seated against backseat 64. The combination of shoulder 66 and backseat 64 is one embodiment of a seal mechanism that prevents leakage proximate bonnet 36 to which external actuator 30 may be attached.

The ability to maintain pressure integrity can be utilized in a variety of subsea systems. For example, in FIG. 7 a subsea horizontal Christmas tree 70 is illustrated. Such a horizontal Christmas tree can be landed on a wellhead at a subsea surface. Typically, a tubing hanger is landed in the Christmas tree to facilitate movement of produced fluid to a desired location.

Figure 7:
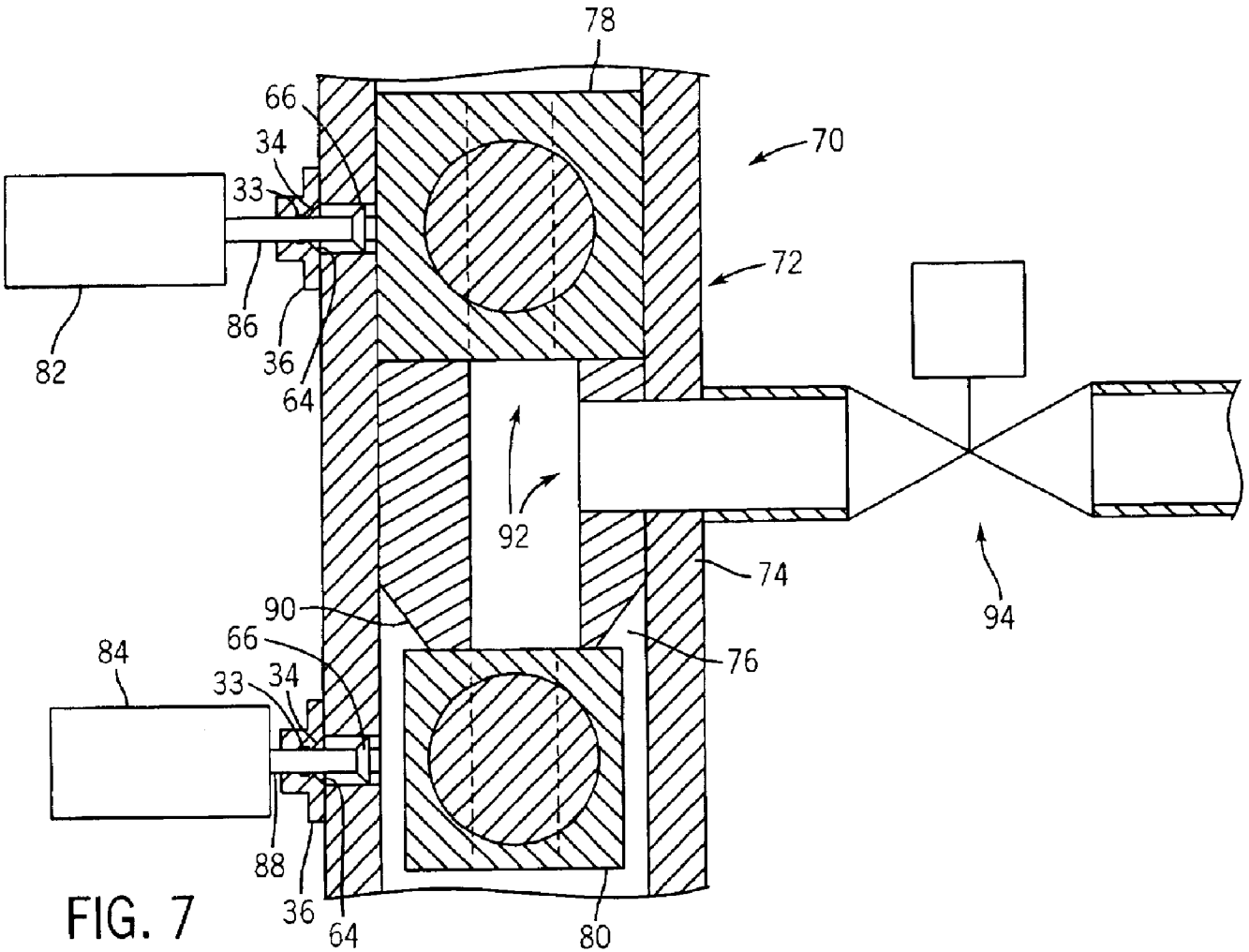
FIG. 7 is a schematic view of an exemplary fluid flow control system, according to one embodiment of the present invention.
Figure 8:
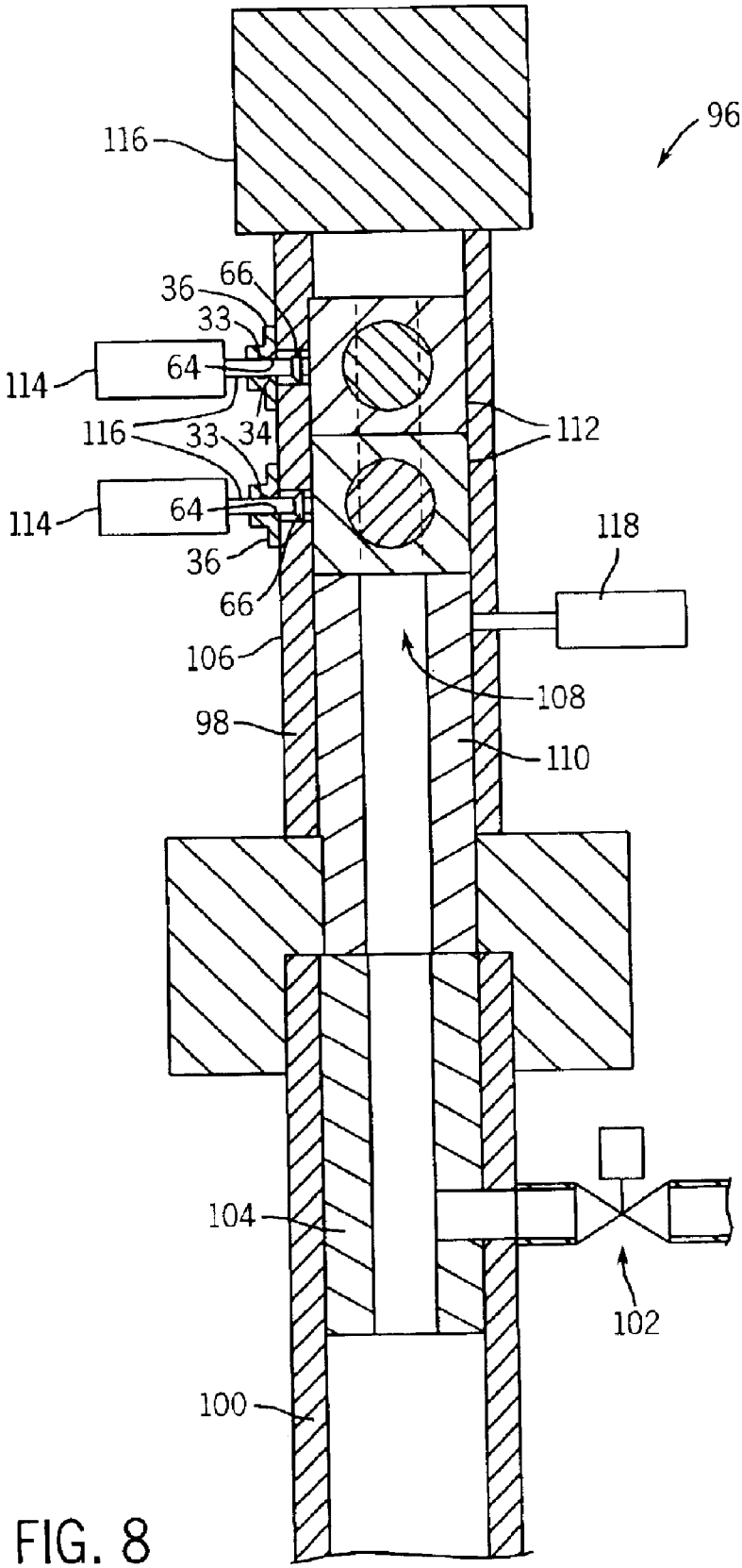
FIG. 8 is a schematic view of another exemplary fluid flow control system, according to another embodiment of the present invention.

In the example of FIG. 7, horizontal Christmas tree 70 comprises a flow control structure 72 having a pressure housing 74. Pressure housing 74 defines an internal fluid flow path 76 to which fluid may be selectively directed via a plurality of valves, such as upper valve 78 and lower valve 80. Internal valves 78 and 80 are controlled by external actuators 82 and 84 via actuator stems 86 and 88, respectively. Each of the stems 86 and 88 may be retracted to their corresponding seal region 34, as described above with reference to FIGS. 1 through 6.

The horizontal Christmas tree may comprise other components, such as a tubing hanger 90 having internal flow passages 92, and a master production valve 94. Additionally, a variety of other features may be utilized with or incorporated into the horizontal Christmas tree 70. However, the design of internal valves 78, 80, external actuators 82, 84 and seal regions 34, allows removal of the valves and/or actuators without compromising the pressure integrity within flow control structure 72. Thus, one or more of the valves, actuators and tubing hanger may be removed, and the horizontal Christmas tree 70 can be left in place on the wellhead without the need to decomplete and seal the well.

In another embodiment of the present invention, pressure integrity is maintained in a subsea test tree system 96. In this exemplary system, a flow control structure 98 is coupled to a Christmas tree 100, such as a horizontal Christmas tree. Christmas tree 100 is coupled to a master production valve 102, and a horizontal Christmas tree tubing hanger 104 is deployed therein. Disposed above Christmas tree 100, flow control structure 98 comprises a pressure housing 106 having a hollow interior that forms an internal fluid flow path 108. A tubing hanger running tool 110 is disposed within pressure housing 106 along with one or more internal valves 112 each actuated by an external actuator 114. In the embodiment illustrated, two internal valves 112 are actuated by corresponding external actuators 114 via actuator stems 116. Subsea system 96 also may comprise other components, such as a blowout preventer 116 and an umbilical-less radial penetrator port 118.

As discussed with respect to the embodiments described above, the actuators 114 and/or valves 112 may be removed without compromising the pressure integrity within flow control structure 98. Each actuator stem 116 is moved to a retracted position via the corresponding actuator and/or the internal pressure within pressure housing 106 to form a seal at the corresponding seal region 34. As described with reference to FIGS. 1 through 3, seal region 34 may be formed by an appropriate backseat 64 that is engaged by the corresponding shoulder 66 of the actuator stem. Thus, the system allows the utilization of internal devices, such as internal valves, with external actuators without compromising the pressure integrity of the system even upon removal of the internal components and external actuators.

It should be understood that the foregoing description is of exemplary embodiments of this invention, and that the invention is not limited to the specific forms shown. For example, a variety of actuators may be used to actuate gate valves, ball valves, other types of valves or other internal components; the technique for maintaining pressure integrity may be utilized in a variety of submersible, e.g. subsea, systems; the number of valves and actuators used in a given system may vary according to the specific application; the internal valves may be actuated by linear, rotational or other motion of the actuator stem; and various other features may be incorporated into the system. These and other modifications may be made in the design and arrangement of the elements without departing from the scope of the invention as expressed in the appended claims.

What is claimed is:

1. A flow control system for controlling fluid flow, comprising:

a pressure housing, said pressure housing defining an internal fluid flow path;

an internal component positioned within said pressure housing;

a valve disposed within said internal component to control fluid flow through said internal fluid flow path;

a valve actuator mounted exterior to said internal fluid flow path; and a valve stem by which said valve actuator adjusts said valve, said valve stem being positionable in:

a retracted position wherein said valve stem is disengaged from said valve and withdrawn from said internal fluid flow path of said pressure housing and wherein said valve stem establishes a pressure seal adapted to contain pressure within said pressure housing; and an extended position wherein said valve stem engages said valve and wherein said pressure seal is not established.

2. The system as recited in claim 1, further comprising a subsea Christmas tree that comprises said pressure housing.

3. The system as recited in claim 1, further comprising a subsea test tree that comprises said pressure housing.

4. The system as recited in claim 1, wherein the valve actuator comprises a hydraulic actuator.

5. The system as recited in claim 1, wherein the valve comprises a gate valve.

6. The system as recited in claim 1, wherein the valve comprises a ball valve.

7. The system as recited in claim 1, wherein the valve is removable from the internal fluid flow path.

8. The system as recited in claim 1, further comprising a backseat sealing region, wherein the valve stem has a shoulder positioned to seal against the backseat sealing region to thereby establish said pressure seal when said valve stem is in the retracted position.

9. The system as recited in claim 8, further comprising a bonnet attached to an exterior of the pressure housing, the bonnet containing the backseat sealing region.

10. A flow control system for controlling fluid flow, comprising:

a pressure housing, said pressure housing defining an internal fluid flow path;

an internal component positioned within said pressure housing;

a valve disposed within said internal component to control fluid flow through said internal fluid flow path;

a valve actuator mounted exterior to said internal fluid flow path; and a valve stem by which said valve actuator adjusts said valve, said valve stem being positionable in:

a retracted position wherein said valve stem is disengaged from said valve and withdrawn from said internal fluid flow path of said pressure housing and wherein a portion of said valve stem engages a backseat sealing region to thereby establish a pressure seal adapted to contain pressure within said pressure housing; and an extended position wherein said portion of said valve stem engages said valve and wherein said portion of said valve stem is disengaged from said backset sealing region such that said pressure seal is not established.

11. The system as recited in claim 10, further comprising a subsea Christmas tree that comprises said pressure housing.

12. The system as recited in claim 10, further comprising a subsea test tree that comprises said pressure housing.

13. The system as recited in claim 10, wherein the valve actuator comprises a hydraulic actuator.

14. The system as recited in claim 10, wherein the valve comprises a gate valve.

15. The system as recited in claim 10, wherein the valve comprises a ball valve.

16. The system as recited in claim 10, wherein the valve is removable from the internal fluid flow path.

17. The system as recited in claim 10, wherein said portion of said valve stem that engages said backseat sealing region comprises a shoulder that is adapted to seal against the backseat sealing region to thereby establish said pressure seal when said valve stem is in the retracted position.

18. The system as recited in claim 10, further comprising a bonnet positioned exterior of the pressure housing, wherein the bonnet contains the backseat sealing region.

19. A flow control system for controlling fluid flow, comprising:

a pressure housing, said pressure housing defining an internal fluid flow path;

an internal component positioned within said pressure housing;

a valve disposed within said internal component to control fluid flow through said internal fluid flow path;

a valve actuator mounted exterior to said internal fluid flow path;

a bonnet mounted exterior to said internal fluid flow path, said bonnet comprising a backseat sealing region; and a valve stem by which said valve actuator adjusts said valve, said valve stem comprising a shoulder and being positionable in:

a retracted position wherein said valve stem is disengaged from said valve and withdrawn from said internal fluid flow path of said pressure housing and wherein said shoulder of said valve stem engages said backseat sealing region to thereby establish a pressure seal adapted to contain pressure within said pressure housing; and an extended position wherein said portion of said valve stem engages said valve and wherein said shoulder of said valve stem is disengaged from said backset sealing region such that said pressure seal is not established.

20. The system as recited in claim 19, further comprising a subsea Christmas tree that comprises said pressure housing.

21. The system as recited in claim 19, further comprising a subsea test tree that comprises said pressure housing.

22. The system as recited in claim 19, wherein the valve actuator comprises a hydraulic actuator.

23. The system as recited in claim 19, wherein the valve comprises a gate valve.

24. The system as recited in claim 19, wherein the valve comprises a ball valve.

25. The system as recited in claim 19, wherein the valve is removable from the internal fluid flow path.

* * * * *